US006851232B1

(12) United States Patent
Schwegler

(10) Patent No.: US 6,851,232 B1
(45) Date of Patent: Feb. 8, 2005

(54) REINFORCEMENT DEVICE FOR SUPPORTING STRUCTURES

(75) Inventor: Gregor Schwegler, Luzern (CH)

(73) Assignee: Sika Schweiz AG, Zurich (CH)

( * ) Notice: Subject to any disclaimer, the term of this patent is extended or adjusted under 35 U.S.C. 154(b) by 0 days.

(21) Appl. No.: 09/486,264

(22) PCT Filed: Aug. 18, 1998

(86) PCT No.: PCT/CH98/00346

§ 371 (c)(1),
(2), (4) Date: May 12, 2000

(87) PCT Pub. No.: WO99/10613

PCT Pub. Date: Mar. 4, 1999

(30) Foreign Application Priority Data

Aug. 26, 1997 (CH) ..... 1987/97

(51) Int. Cl.[7] ..... B32B 31/00

(52) U.S. Cl. ..... 52/223.8; 52/724.1; 52/724.2; 52/731.1; 156/71; 156/254

(58) Field of Search ..... 156/160, 163, 156/254, 71; 52/223.8, 731.1, 724.1, 724.2; 138/109; 464/182

(56) References Cited

U.S. PATENT DOCUMENTS 4,467,836 A * 8/1984 Ragout ..... 138/93
4,895,185 A * 1/1990 Champleboux et al. ..... 138/109
4,966,802 A * 10/1990 Hertzberg ..... 428/119
5,313,749 A * 5/1994 Conner ..... 52/223.12
5,471,812 A * 12/1995 Muller ..... 52/745.19
5,937,606 A * 8/1999 Meier et al. ..... 52/600
5,980,669 A * 11/1999 Maumus et al. ..... 156/148

FOREIGN PATENT DOCUMENTS

| | | |
|---|---|---|
| DE | 36 40 549 A1 | 6/1988 |
| FR | 2 590 608 | 5/1987 |
| WO | WO 96/21785 | 7/1996 |

OTHER PUBLICATIONS

English translation of International Preliminary Examination Report for International application No. PCT/CH98/00346.

* cited by examiner

*Primary Examiner*—Jeff H. Aftergut
(74) *Attorney, Agent, or Firm*—Crowell & Moring LLP

(57) ABSTRACT

The ends of carbon plates reinforcing supporting elements, such as concrete beams, are divided into at least two splines having approximately the same thickness and are glued in the appropriate retaining slots of a terminal element. The splines form an angle in relation to each other. This assembly is then glued to the traction side of the supporting element, whereby the carbon plates are directly prestressed by the terminal elements in relation to the supporting element. The terminal element can be inserted into an appropriate groove in the supporting element or glued directly on the surface of the supporting element and/or doweled, optionally by using a transverse tensioning device.

11 Claims, 3 Drawing Sheets

REINFORCEMENT DEVICE FOR SUPPORTING STRUCTURES

BACKGROUND AND SUMMARY OF THE INVENTION

The present invention relates to a reinforcing device as well as a method for reinforcing beams.

When rehabilitating supporting structures in existing buildings, the supporting structures often are to be adapted for new load cases that exceed the former dimensions. In order to avoid replacing a supporting structure completely in such cases, methods and devices for reinforcing such an existing supporting structure have been found. Such supporting structures can be walls of conventional design made of brick, reinforced concrete walls or beams, or beams made of wood, plastic, or steel, for example.

Reinforcement of such supporting structures with steel plates added later has been known for a long time. The steel plates, namely strips of sheet steel or steel panels, are glued to one or both sides of the supporting structure, preferably on the side of the supporting structure subjected to tension. The advantage of this method is that it can be implemented relatively quickly, but the method imposes strict requirements on the adhesive. In other words, the preparation of the parts and the performance of the adhesion process must take place under precisely defined conditions to achieve the desired effect. Problems, and especially corrosion problems, arise when supporting structures such as bridge beams are to be reinforced in this manner in the open. Because of the relatively high weight and the production of such steel panels, the maximum length that can be used is limited. Likewise, for reasons of space, installation in closed spaces can be problematic when the rigid steel panels cannot be transported into the space in question. In addition, the steel plates must be pressed against the supporting structure to be reinforced until the adhesive sets in "overhead" applications. This also results in high cost.

It is known from French Publication 2 590 608 to use tensioning means in the form of strips of metal or fiber-reinforced plastic with anchors at the ends. In this embodiment, however, there is no flush connection between the tensioning means and the supporting structure. Instead, a connection with the supporting structure is provided only in the two end anchoring points of the tensioning means. Clamping means of this kind are conventionally included when planning the supporting structure, because retrofitting is practically impossible or can be done only at very high cost, since corresponding channels in the supports must be prepared for the clamping means.

Recently, carbon panels (CFK panels) have been glued to the tensioned sides of the supporting structure and, thus, the carrying capacity of such structures is subsequently improved by increasing the supporting resistance and ductility. Advantageously, the simple and economical application of such panels, which have a higher strength than steel panels with a far smaller weight, is provided, and the panels are simpler to install. The corrosion resistance is also better so that such reinforcements are also suitable for reinforcing supporting structures in the open. However, the end anchoring of the panels has proven to be particularly problematical. The danger of the panels coming loose is particularly great in this areas and there is a problem in that the force is introduced from the end of the panel into the beam.

A solution is this regard is known from international publication WO96/21785; here, a bore that runs at an obtuse angle or a wedge-shaped recess is made in the beam in which the ends of the CFK panels are inserted and pressed against the beam, possibly by clamps, loops, plates, etc. This results in an improvement in loosening behavior and an improved initiation of the force from the beam into the panel. However, such CFK panels are glued without pretensioning, in other words flexibly, to the beam. As a result, much of the reinforcing potential of these panels is not utilized, since panels begin to provide support only after they exceed the basic load, in other words under stress from the useful load itself.

In order to utilize the panels better, the idea has arisen of gluing them pretensioned to the beam. One known solution 1 in this regard provides that short steel plates are glued to the ends of the CFK panels on both sides. The steel plates are then pulled apart and the CFK panels are pretensioned, and this pretensioned arrangement is glued to the beam to be reinforced. After the glue dries, the panels are pressed at the ends against the beams by plates, loops, etc. and the ends are then cut off with the steel plates. This method, however, is very expensive and cannot be used in all applications. The method of anchoring the panel ends described above is also not suitable for pretensioning at building sites.

Hence, the goal of the present invention is to provide a CFK reinforcing panel in which the introduction of force from the beam into the ends takes place in such fashion that separation becomes practically impossible and which is also suitable for pretensioning.

This goal is achieved by splitting the ends of a CFK panel into at least two and preferably three or more end; strips. In this way, the surface for connection to an end element is increased considerably. As a result, there is a good initiation of the force into the ends of the CFK panel which can also be pretensioned in simple fashion by such an end element. The end element in block form can be either inserted into a depression in the beam or, in the preferred embodiment, with a wedge-shaped split with a flat or rough bottom, can also be glued and/or doweled or simply bolted flush to the beam. It is this embodiment that is preferably suited for pretensioning which preferably takes place directly through the beam part. For example, this can be done by tensioning against a fitting inserted into the beam.

The splitting of the ends of the CFK panels preferably takes the form either of strips on top of one another or strips that are side-by-side, or in a combination of these two versions.

The ends of the CFK panels can advantageously be split at the building site itself to the required length and dimensions. This makes this system highly universal for the reinforcement of practically any beam, and the system can be employed with or without pretensioning.

The invention is described in greater detail below with reference to the figures in the enclosed drawings.

DESCRIPTION OF THE PREFERRED EMBODIMENTS

Figure 1:
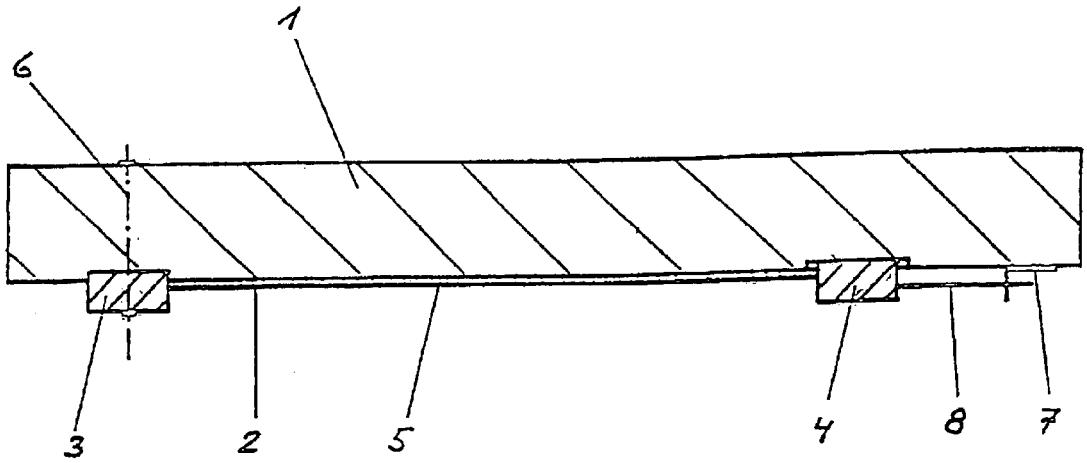
FIG. 1 shows a cross section through a beam with a CFK panel according to the invention attached to its underside.

FIG. 1 shows a cross section through a beam 1 to be reinforced. The ends of the CFK panel 2 used for this purpose are inserted according to the invention in elements, in this case anchor heads 3 and 4. Anchor heads 3 and 4 can be inserted into milled or pointed recesses of beam 1 as shown in this figure. CFK panel 2 is connected with beam 1 over part or all of the area by a layer of adhesive 5 and the anchor heads 3 and 4 are glued to it as well. In addition, anchor heads 3 and 4 can be connected with the beam by a transverse clamping device 6, shown here simply schematically, resulting in an improved direction of the force through the anchor heads 3 and 4 from the CFK panel 2 into the beam 1. This transverse clamping device 6 can be for example, a threaded rod or dowel guided through the beam 1 and the anchor heads 3 and 4.

The reinforcing device composed of the CFK panel 2 and the anchor heads 3 and 4 can also be simply pretensioned as shown schematically on the right-hand side of FIG. 1. For this purpose, for example, an angular fitting 7 can be attached to the underside 1 of the beam. This fitting is gripped by a tension rod 8 connected at one of its ends by the anchor head 4. It is advantageous to provide both of the anchor heads 3 and 4 with such a tensioning device for pretensioning. The clamping device is mounted before gluing and can be removed again after the adhesive cures between the CFK panel 2 or the anchor heads 3 and 4 and the beam 1.

Figure 2:
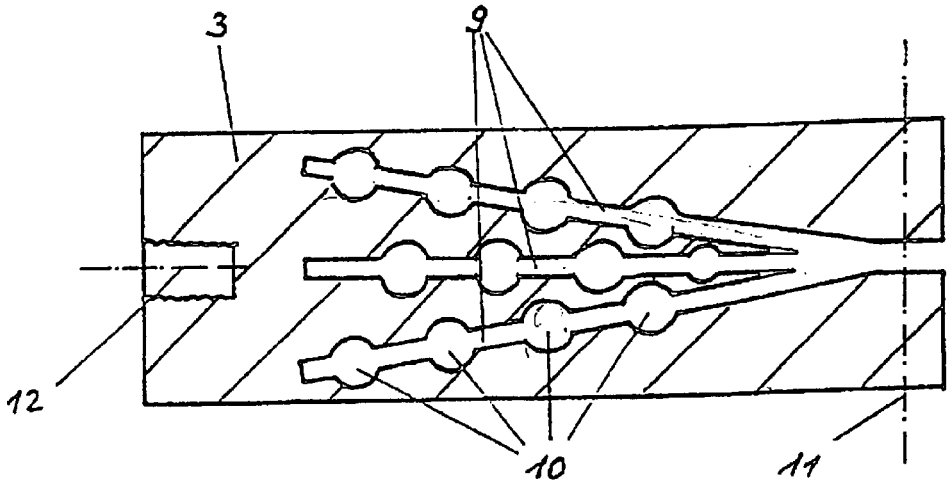
FIG. 2 shows a cross section through the head part of the CFK panel in FIG. 1.
Figure 3:
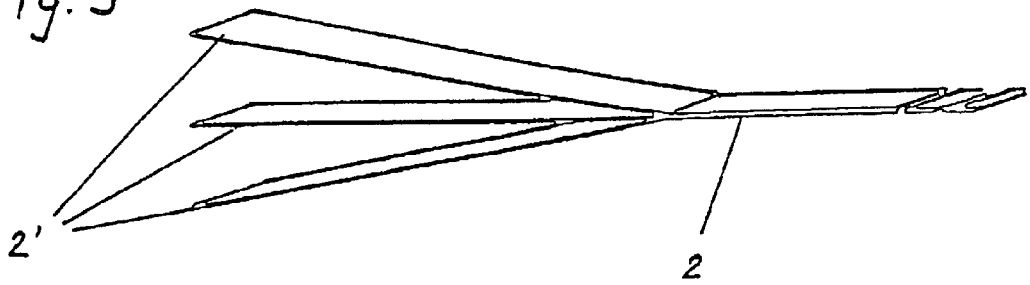
FIG. 3 shows a cross section through the end of a CFK panel according to FIGS. 1 and 2.

FIG. 2 shows a cross section through one of the anchor heads 3. In the anchor head 3, in the form of a parallelepiped, preferably three guide or retaining slots 9 are provided one above the other. These slots can accept the end of CFK panel 2 after it is divided into three tabs 2' as shown in FIG. 3.

Retaining slots 9 are spread upward and downward wedgewise and have transverse bores 10. These bores 10 provide additional anchoring points for the adhesive that connects the strips 2' of the CFK panel 2 with the retaining slots 9. In this way, the introduction of tensile forces from the beam 1 through the anchor head 3 into the CFK panel 2 is additionally improved. The great advantage, however, lies in splitting the end of the panel 2 into the strips 2'. This splitting is preferably performed in the fiber direction of the panels and advantageously results in an increase in gluing area without the strength properties of the CFK panel 2 being adversely affected.

In the present example with three strips 2', the gluing area is increased six times with respect to a conventional panel that is simply glued at its end to the beam, and is increased three times over the known solution with a wedge-shaped recess in the beam and adhesion bridges.

In order to prevent bending or tearing in the outlet area of the anchor head 3 of the CFK panel 2 by transverse forces that result from the wedge-shaped or arcuate arrangement of the retaining slots 9, a transverse reinforcement 11 which is only indicated schematically in FIG. 2 is provided. For example, this transverse reinforcement 11 can be provided by threaded rods guided through matching bores in anchor head 3 and tightened by nuts. Thus, any shear stress peaks in the outlet area of anchor head 3 are subject to overpressure and higher shear stresses are permitted in this zone.

In addition, a threaded bore 12 is provided in anchor head 3, for example, into which bore a pretensioning device can be screwed as shown schematically in FIG. 1.

FIG. 3 shows, as already mentioned, one end of the CFK panel 2 with the end of the panel split into three strips 2'. The CFK panel can be split by conventional means following cutting to length, to the desired length and the; desired number of equally thick strips 2'. Cutting may be performed, for examples by a plane or knife. It, is advantageous in this regard that relatively low requirements are imposed on the quality of the splitting; the important aspect is the division into the correct number of strips 2' to achieve the increase in area for the connection to the anchor head 3.

Figure 4:
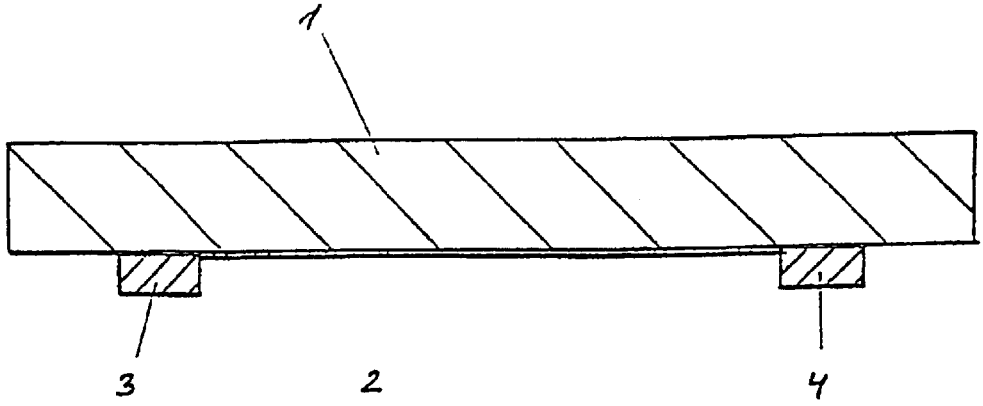
FIG. 4 shows a cross section through a beam with an additional CFK panel according to the invention mounted on the underside.

FIG. 4 shows a cross section through a beam 1 with a reinforcing device according to the invention mounted on the underside (tension side), consisting of a CFK panel 2 with anchor heads 3 and 4 attached to the ends. Anchor heads 3 and 4 are so designed that the CFK panel 2 emerges practically at the level of adhesive layer 5 from the anchor heads 3 and 4 and the latter, therefore, must not be depressed in the underside of beam 1 but must also be glued flush to the underside. Of course, the transverse tensioning devices 6 shown in FIG. 1 can also be mounted here to produce a higher pressure and thus a higher tensile strength of the connection between anchor heads 3 and 4 and the underside of the beam. Likewise, these anchor heads 3 and 4, like the embodiment already described above, can be pretensioned simply.

Figure 5:
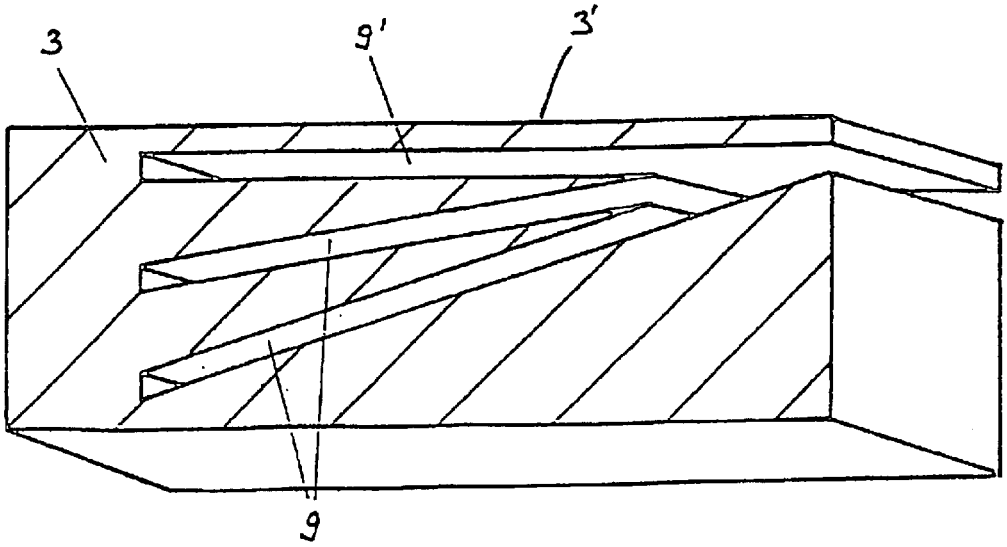
FIG. 5 shows a cross section through the head part of the CFK panel according to FIG. 4.

FIG. 5 shows a cross section through an anchor head 3 and the corresponding arrangement of the holding slots 9. The bottom slot 9' is parallel to the outside wall 3' of the anchor head 3, resting on beam 1, and the other slots 9 are located at an acute angle pointing outward in the form of a fan. This arrangement offers the same advantages as already described as a result of the increase in the gluing surface of the CFK panel 2 and also allows the flush application of anchor heads 3 and 4 as well without additional recesses in beam 1. These anchor heads 3 and 4 also have transverse reinforcing means 11, as shown schematically in FIG. 2, to avoid bending or tearing of anchor heads 3 and 4 in the area where the CFK panel 2 emerges.

As material for the anchor heads 3, 4, metal which exhibits high strength, ease of machining, and good force initiation properties is suitable, as is plastic, especially when corrosion is expected to be high.

Figure 6:
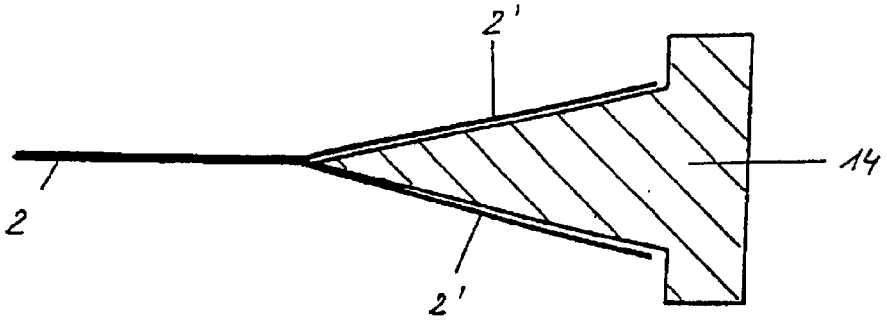
FIG. 6 shows a schematic cross section through an alternative head part of a CFK panel according to the invention.

FIG. 6 is a schematic view of another embodiment of the reinforcing device according to the invention. The end of, the CFK panel 2 is split here into two superimposed strips 2' which come to rest on the outside of a wedge-shaped anchor head 14. There they can be connected to the surface of the anchor head 14 by gluing.

Figure 7:
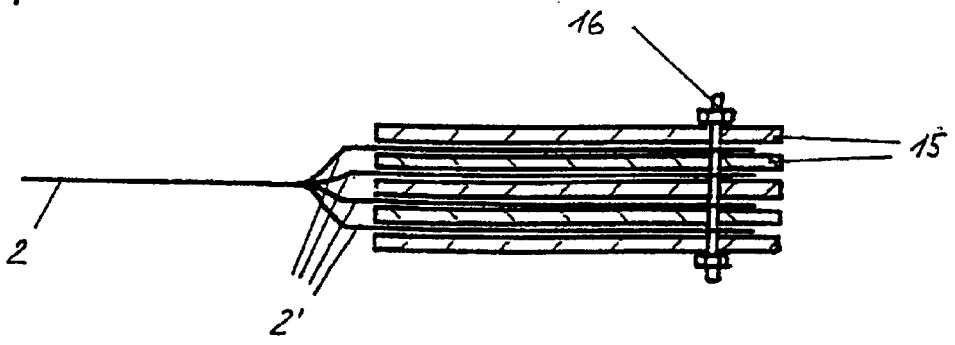
FIG. 7 is a schematic cross section through an additional alternative head part of a CFK panel according to the invention.

In another embodiment according to the invention, the split strips 2' at the end of the CFK panel 2 are held in an anchor head composed of plates 15 located parallel one on top of the other as shown in a lengthwise section in FIG. 7. Here a screw connection 16 can be advantageously employed to press the plate 15 and the strips 2' against one another.

Figure 8:
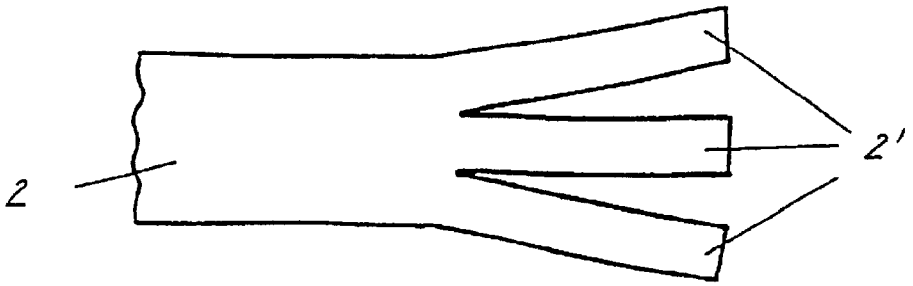
FIG. 8 is a top view of another alternative embodiment of the head part of a CFK panel.

FIG. 8 is a top view of another embodiment of the end of the CFK panel 2. Here, the strips 2' are not shown one on top of the other but are located laterally side by side. Here again, the split is preferably made in the fiber direction of the CFK panel 2.

The reinforcing devices according to the invention are especially suited for rehabilitating existing concrete beam structures, such as ceilings or bridge beams. However, they can also be used for all known applications of conventional CFK panels, for example masonry and wooden supporting structures. The ease with which they can be pretensioned permits a greater utilization of the strength properties of the CFK panels than in known methods. In addition, pretensioning means that on the tension side of an existing supporting element, pre-pressing takes place that is advantageous, for examples in bridge beams.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Reinforcing device for supporting structures comprising:

a carbon panel, at least one end of the carbon panel being split into at least two strips, and an end element in which said at least one end terminates, wherein the strips are inserted at least partially into retaining slots of the end element that are located wedgewise relative to one another.

2. Reinforcing device according to claim 1 wherein the end element in the vicinity of the outlet of the carbon panel has at least one transverse reinforcement located transversely to an outlet direction.

3. Reinforcing device according to claim 2, wherein reinforcement is a threaded rod.

4. Reinforcing device according to claim 1 wherein each of two ends of the carbon panel terminates in an end element.

5. Reinforcing device according to claim 1 wherein said retaining slots of the end element have a rough or corrugated surface.

6. Reinforcing device according to claim 1 wherein bores oriented transversely to the surface of the panel are located in the end element in the vicinity of said retaining slots.

7. Reinforcing device according to claim 1 wherein the end element has a threaded bore opposite the outlet of the carbon panel.

8. Reinforcing device according to claim 1 wherein the retaining slots are located wedgewise in the end element such that a lowest retaining slot is parallel to the outlet direction of the carbon panel and each of the other retaining slots is located fanwise with an increasing angle from the outlet opening.

9. Reinforcing device according to claim 1, wherein the end element comprises at least two spaced apart components to form slots into which the strips are at least partially inserted.

10. Reinforcing device for supporting structures comprising:

a carbon panel, at least one end of the carbon panel being split into at least two strips, and an end element in which said at least one end terminates and having slots to receive the strips, wherein the end element is a parallelepiped made of metal or plastic.

11. Method for reinforcing supporting elements with reinforcing devices comprising:

cutting carbon panels to an appropriate length, separating or splitting each panel at at least one end into at least two strips of approximately the same thickness or width, bringing the at least one end into a connection with an end element to form an arrangement, and gluing the arrangement to a tension side of a supporting element to be reinforced, wherein the strips of approximately the same thickness or width are introduced into separate retaining slots of the end element which are arranged fanwise with respect to one another and glued in place or soaked with an adhesive.

* * * * *